United States Patent [19]

Kaye

[11] Patent Number: 4,914,776

[45] Date of Patent: Apr. 10, 1990

[54] TUBE-CLEANING APPARATUS

[75] Inventor: Diane M. Kaye, Racine, Wis.

[73] Assignee: Lewisan Products, Inc., Racine, Wis.

[21] Appl. No.: 293,180

[22] Filed: Jan. 3, 1989

[51] Int. Cl.[4] ..... B08B 9/02

[52] U.S. Cl. ..... 15/104.33; 15/143 R; 81/487; 254/134.3 FT

[58] Field of Search ..... 15/104.31, 104.33, 143 R; 254/134.3 FT; 81/487

[56] References Cited

U.S. PATENT DOCUMENTS 1,653,002 12/1987 Coleman ..... 15/104.33 X
1,782,871 11/1930 Fischer ..... 15/104.33 X
1,844,433 2/1932 Markowitz ..... 254/134.3 FT
4,819,911 4/1989 Cielker ..... 254/134.8 FT

*Primary Examiner*—Edward L. Roberts
*Attorney, Agent, or Firm*—Peter N. Jansson

[57] ABSTRACT

An improved tube-cleaning apparatus of the type having a flat drain-insertable and retractible strip and a grip handle slidable along and engageable with the strip. The improvement includes opposed wiper edges engageable with the strip and serving to clean the strip during movement of the grip handle along the strip. In certain preferred embodiments, opposed wiper edges are biased against the strip and half handles forming the grip handle are structures which are integrally-formed to provide the desired biasing without interfering with other grip handle functions.

23 Claims, 2 Drawing Sheets

TUBE-CLEANING APPARATUS

FIELD OF THE INVENTION

This invention is related generally to tube-cleaning apparatus and, more particularly, to handles for use in insertion and retraction of long flat strips used in drain cleaning operations and the like.

BACKGROUND OF THE INVENTION

A wide variety of equipment has been developed for tube-cleaning operations, and particularly for drain cleaning. Various sewer rods, snakes, drills and the like are well known in the art.

One type of tube-cleaning apparatus has a flat strip which is progressively insertable and retractible with respect to a drain tube and a grip handle slidable along such strip and engageable therewith. The grip handle is moved to different positions along the strip as the insertion or retraction progresses. Many different devices of this kind have been developed. Some of such devices are referred to as sewer rods.

Drain cleaning using sewer rods or other apparatus of the type last described is never a pleasant task. The flat strip is hard to handle because of its springiness and because of frequent difficulty of insertion into a drain. And, when the strip is withdrawn it is covered with filthy waste material which gets on the hands of the operator and elsewhere due to the wet condition of such waste and/or the springiness of the strip. The grip handles of such tube-cleaning apparatus often become covered with waste material, making continued operation a rather disgusting task.

Another problem with prior tube-cleaning apparatus of this type is that the grip handles are often difficult to manipulate. Such devices are typically made of two half handles which are pivotably interconnected to form the grip handles, and the difficulty in manipulation is due in part to the nature of the pivotable interconnections. In some cases, yokes encircle portions of such half handles, and such half handles are not readily aligned. Furthermore, such constructions typically have several pieces which make assembly difficult.

There is a need for improvements in tube-cleaning apparatus of the type described.

OBJECTS OF THE INVENTION

It is an object of this invention to provide an improved tube-cleaning apparatus overcoming some of the problems and shortcomings of the prior art.

Another object of this invention is to provide an improved tube-cleaning apparatus of the type having a flat progressively insertable and retractible strip and a grip handle slidable therealong and engageable therewith.

Another Object of this invention is to provide an improved tube-cleaning apparatus minimizing problems associated with waste and other dirt which accumulate on the strips of such apparatus during drain-cleaning operations and the like.

Another object is to provide improved tube-cleaning apparatus of the type described which is simple and inexpensive to manufacture.

Another object of this invention is to provide an improved tube-cleaning apparatus of the type described which is easy to operate.

These and other important objects will be apparent from the descriptions of this invention which follow.

SUMMARY OF THE INVENTION

This invention is a tube-cleaning apparatus which overcomes the problems and shortcomings mentioned above. The invention is an improvement in tube-cleaning apparatus of the type which has a flat longitudinally-bendable progressively insertable and retractible strip and a grip handle slidable along and engageable with the strip.

The grip handle of the invention is formed by a pair of opposed half handles located on opposite surfaces of the strip and pivotably interconnected with each other for relative pivoting about an axis which is transverse to the strip. The half handles have opposed hand portions which are rearward of the pivot axis. They also have means for gripping contact with the strip, such gripping occurring when the hand portions are squeezed together.

The half handles have front portions forward of the pivot axis which terminate in opposed wiper edges engaged with the strip. Such edges serve to clean waste material and other drain dirt from the strip during the movements of the grip handle along the strip during insertion and retraction from a drain or the like.

The opposed wiper edges are preferably biased against the strip for good cleaning action on the strip. Most preferably, the biasing is such that, with the strip removed from between the wiper edges, the wiper edges are closer to one another at all relative pivot positions of the half handles than the thickness of the strip. Thus, whether or not the grip handle is firmly engaging the strip, the wiper edges have a good cleaning engagement with the surfaces of the strip. It is not necessary to spread the hand portions to achieve a good cleaning action.

The half handles are preferably integrally-formed structures. Such integrally-formed structures are designed to achieve the desired biasing and cleaning action and to do so well without compromising the known gripping functions of such device. The manufacturing of grip handles having such integrally-formed half handles is made easy.

In highly preferred embodiments, the front portions of the half handles are tapered toward their edges. And, the half handles are made of a material which, given such tapering, allows the wiper edges to be resiliently deformable. This improves the firmness and closeness of engagement of the wiper edges with the surfaces of the strip.

The pivot interconnection of the half handles is preferably by means of snap-engagable male and female hinge members which define the pivot axis. If the half handles are each integrally-molded pieces, the male and female hinge members may be snapped together shortly after molding.

The aforementioned means for gripping contact with the strip are preferably opposed strip-grip portions which project toward each other on each of the half handle. Such strip-grip portions are preferably just rearward of the pivot axis. This provides a good grip on the strip and does not interfere with operation of the wiper edges.

DETAILED DESCRIPTION OF PREFERRED EMBODIMENTS

Figure 1:
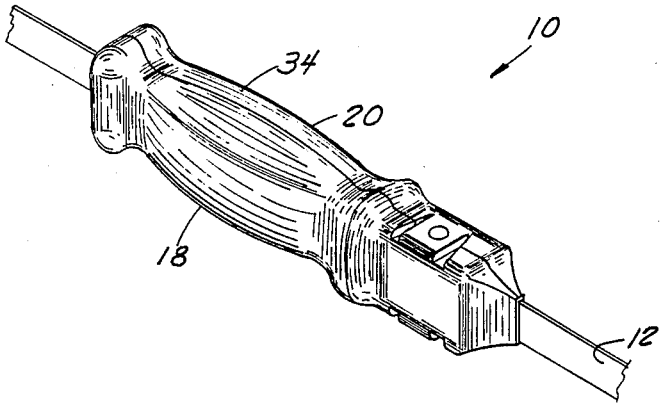
FIG. 1 is a perspective view of an improved tube-cleaning apparatus in accordance with this invention.

The drawings illustrate a tube-cleaning apparatus 10 which has a strip 12 and a grip handle 14 used for moving strip 12. Strip 12 and grip handle 14 are the principal parts of the invention. Grip handle 14 is illustrated in detail in the figures. Tube-cleaning apparatus 10 has other portions which are not shown since they are not part of the invention.

Strip 12 is a flat metal band made of spring steel. Strip 12 is on the order of 1.2 mm thick and 12 mm wide, and has opposed flat surfaces 14. Strip 12 is typically several meters in length and may be coiled for storage and uncoiled during use. In use, strip 12 is progressively inserted into and later retracted from a drain or other tube requiring inside-surface cleaning.

Such insertion and retraction are carried out by means of grip handle 14, which is used to engage strip 12 to push or pull it during the insertion and retraction actions. After engagement for such pulling or pushing, grip handle 14 is moved along strip 12 to a new position along strip 14 where the strip is again engaged for additional pulling or pushing. Such actions are carried out in a manner generally known in the prior art.

Grip handle 14 is formed by a pair of opposed half handles 18 and 20. Half handles 18 and 20, except for pivot interconnection portions (hereafter described), are mirror images of one another. Half handles 18 and 20 have opposed inside surfaces 22 which are adjacent to the opposed surfaces 16 of strip 12. Half handles 18 and 20 also have outside surfaces 24.

Half handles 18 and 20 are pivotably interconnected by means of the engagement of a pair of male hinge members, 26 which extend laterally from the remaining portion of half handle 18, with a pair of female hinge members 28, which are on half handles 20. Female hinge members 28 are lateral tabs which have holes 30 positioned to receive male hinge members 26. Male and female hinge members 26 and 28 define a pivot axis 32 about which half handles 18 and 20 pivot with respect to each other. Pivot axis 32 is transverse to strip 12, extending thereacross at a 90 degree angle to the length of strip 12.

As already noted, each of the half handles 18 and 20 has portions which are mirror images to like portions on the other half handle. Each half handle includes a hand portion 34 which is rearward of pivot axis 32. When hand portions 34 are squeezed together, grip handle 14 engages strip 12 for movement thereof. Such strip engagement is by means of opposed strip-grip portions 36 which project inwardly toward each other on inside surfaces 22 of half handles 18 and 20. Strip-grip portions 36 are themselves rearward of pivot axis 32, but are relatively close to pivot axis 32 such that a substantial mechanical advantage is achieved when hand portions 34 are squeezed together.

Each of the half handles 18 and 20 also includes a front portion 38 which is forward of pivot axis 32. Each of the front portions 38 terminates in a wiper edge 40 which is engaged with a surface 16 of strip 12 across the width of such strip. Together, half handles 18 and 20 provide opposed wiper edges 40 on opposite surfaces 16 of strip 12. As grip handle 14 moves in either direction along strip 12, wiper edges 40 serve to clean waste material which has adhered to strip 12 from the strip.

Half handles 18 and 20 are each integrally-formed structures made by well-known plastic molding techniques. Each front portion 38 is tapered to progressively smaller dimensions at positions progressively closer to wiper edge 40. This tapering is such that, given the material chosen for the molding of half handles 18 and 20, wiper edges 40 have a degree of resilient deformability. Such resilient deformability provides a close squeegee-like engagement of wiper edges 40 with surfaces 16 of strip 12.

The exact thickness dimensions most favorable for such squeegee-like action are dependent on the material selected for the integral molding of each half handle. A preferred material for half handles 18 and 20 is high density polyethylene. Another acceptable material is nylon. A wide variety of moldable plastics and other materials may be used. Appropriate choices would be known to those skilled in the art who are familiar with this invention.

Opposed wiper edges 40 are biased against opposed surfaces 16 of strip 12. Such biasing is due to the inherent resilient flexibility of the material used in forming half handles 18 and 20. The precise configurations of each wiper edges 40 and its positioning with respect to the remainder of the half handles of which it is a part are chosen such that, with strip 12 removed from grip member 14, wiper edges 40 are closer to one another than the thickness of strip 12. Thus, assembly of half handles 18 and 20 with strip 12 causes a spreading of opposed wiper edges 40, and this relationship of wiper edges 40 exists for any relative pivot positions of half handles 18 and 20.

Such biased engagement of wiper edges 40 with strip 12, therefore, exists even while hand portions 34 are squeezed together for engagement of strip-grip portions 36 with strip 12. Release of the squeezing pressure on hand portions 34 tends to slightly increase the biasing force of wiper edges 40 on strip 12, and it is in this condition that grip handle 14 is moved along strip 12 between the insertion and retraction motions of strip 12 with respect to a drain or the like. Thus, wiper edges 40 provide good cleaning action as grip handle 14 moves along strip 12.

Figure 5:
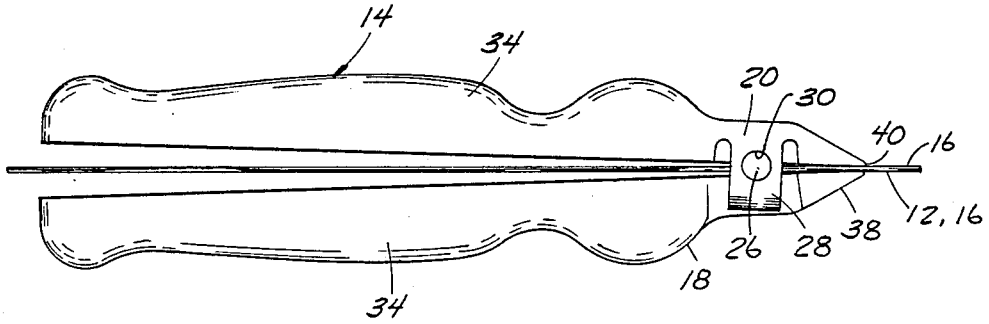
FIG. 5 is a similar side sectional view showing the device with the grip released.
Figure 2:
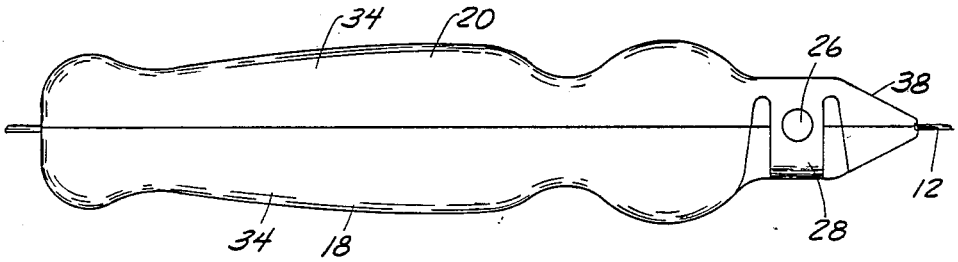
FIG. 2 is a side elevation of FIG. 1.
Figure 3:
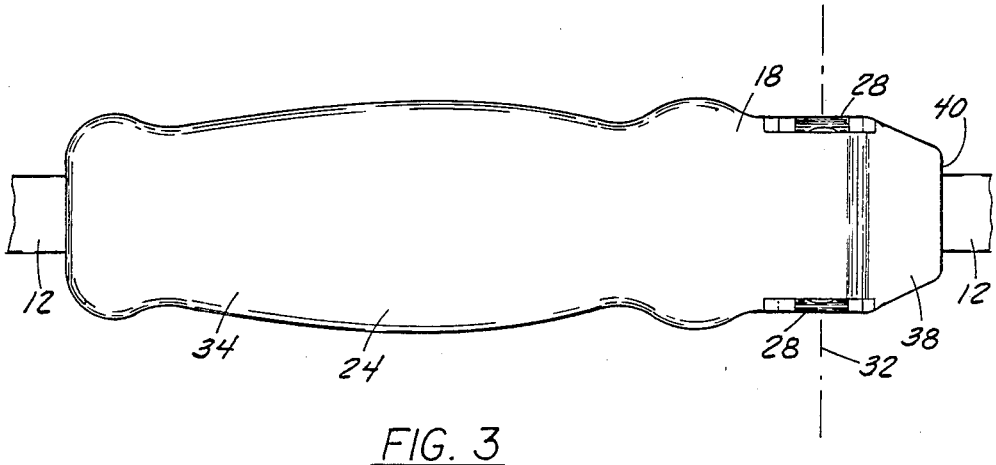
FIG. 3 is a top sectional view taken along section 3—3 as illustrated in FIG. 2.
Figure 4:
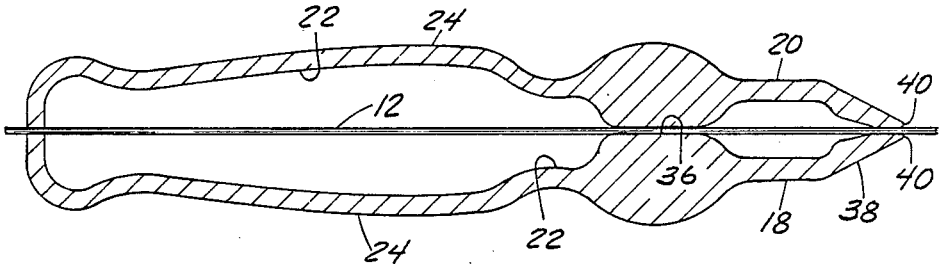
FIG. 4 is side sectional view illustrating the device in gripping condition, and having the front portion magnified for greater detail.

FIGS. 4 and 5 illustrate the relative positions of half handles 18 and 20 and strip 12 during different stages of operation. FIG. 4 shows grip handle 14 with hand portions 34 squeezed together and strip-grip portions 36 engaging strip 12. Note that even in this condition, wiper edges 40 are biased toward engagement with surfaces 16 of strip 12. FIG. 5 shows grip handle 14 with hand portions 34 released, as is the case form movement of grip handle 14 along strip 12. It is this condition in which wiper edges 40 perform their strip cleaning function.

In construction of tube-cleaning apparatus 10, half handles 18 and 20 may be joined together, after molding, by snap connection of their respective male and female hinge members 26 and 28. Such snap connection preferably is done shortly after the parts are stripped from their molds. Later, strip 12 is slid between half handles 18 and 29, moving first between hand portions 34 and finally between wiper edges 40. During such movement, wiper edges 40 are spread and such deformation produces the biasing force previously mentioned.

A wide variety of materials may be used in forming grip handle 14. While integral construction of each of the half handles is preferred, other constructions are possible. While the forward position of wiper edges 40 is preferred, other positions are possible.

While the principles of this invention have been described in connection with specific embodiments, it should be understood clearly that these descriptions are made only by way of example and are not intended to limit the scope of the invention.

I claim:

1. In tube-cleaning apparatus of the type having a flat longitudinally-bendable progressively insertable and retractible strip and a grip handle slidable along and engageable with the strip, the improvement wherein:

the grip handle is formed by a pair of opposed half handles on opposite surfaces of the strip and pivotably interconnected about an-axis transverse to the strip; and the half handles have hand portions rearward of the axis, means for gripping contact with the strip, and front portions forward of the axis terminating in opposed wiper edges engaged with the strip.

2. The tube-cleaning apparatus of claim 1 wherein the opposed wiper edges are biased against the strip.

3. The tube-cleaning apparatus of claim 2 wherein the biasing is such that, with the strip removed from between the wiper edges, the wiper edges are closer to one another at all relative pivot positions of the half handles than the thickness of the strip.

4. The tube-cleaning apparatus of claim 1 wherein each half handle is an integrally-formed structure.

5. The tube-cleaning apparatus of claim 4 wherein:

the opposed wiper edges are biased against the strip; and the structures are tapered toward their edges and of a material such that the wiper edges are resiliently deformable, thereby to closely engage the strip.

6. The tube-cleaning apparatus of claim 5 wherein the biasing is such that, with the strip removed from between the wiper edges, the wiper edges are closer to one another at all relative pivot positions of the half handles than the thickness of the strip.

7. The tube-cleaning apparatus of claim 4 wherein the half handles have snap-engageable male and female hinge members along the axis to form the pivotable interconnection.

8. The tube-cleaning apparatus of claim 7 wherein:

the opposed wiper edges are biased against the strip; and the structures are tapered toward their edges and of a material such that the wiper edges are resiliently deformable, thereby to closely engage the strip.

9. The tube-cleaning apparatus of claim 8 wherein the biasing is such that, with the strip removed from between the wiper edges, the wiper edges are closer to one another at all relative pivot positions of the half handles than the thickness of the strip.

10. The tube-cleaning apparatus of claim 9 wherein the means for gripping contact with the strip are opposed strip-grip portions projecting toward each other on each half handle at a position rearward of the axis.

11. In tube-cleaning apparatus of the type having a flat progressively insertable and retractible strip and a grip handle slidable therealong and engageable therewith, the improvement wherein the grip handle has a strip grip portion and a wiper edge which is engaged with the strip at a position spaced from the strip grip portion in a direction along the strip, whereby the strip is cleaned as it is retracted.

12. The tube-cleaning apparatus of claim 11 including a pair of the wiper edges on opposite surfaces of the strip.

13. The tube-cleaning apparatus of claim 12 wherein the wiper edges are biased against the strip.

14. The tube-cleaning apparatus of claim 13 wherein the biasing is such that, with the strip removed from between the wiper edges, the wiper edges are closer to one another than the thickness of the strip.

15. The tube-cleaning apparatus of claim 14 wherein the grip handle is formed of two half handles, each half handle being integrally-formed and including one of the wiper edges.

16. The tube-cleaning apparatus of claim 15 wherein:

the opposed wiper edges are biased against the strip; and the structures are tapered toward their edges and of a material such that the wiper edges are resiliently deformable, thereby to closely engage the strip.

17. A grip handle for use in insertion and retraction of a tube-cleaning strip comprising a pair of opposed half handles pivotably interconnected about a pivot axis and adapted to receive the strip therebetween, the half handles having hand portions rearward of the axis, means for gripping contact with the strip, and front portions terminating in opposed wiper edges engageable with the strip.

18. The grip handle of claim 17 wherein:

the opposed wiper edges are biased against the strip;

each half handle is an integrally-formed structure, the structures being tapered toward their edges and of a material such that the wiper edges are resiliently deformable, thereby to closely engage the strip.

19. The grip handle of claim 18 wherein the half handles have snap-engageable male and female hinge members along the axis to form the pivotable interconnection.

20. In tube-cleaning apparatus of the type having a flat progressively insertable and retractable strip and a grip handle slidable therealong and engageable therewith, the improvement wherein the grip handle has a pair of wiper edges engaged with the strip on opposite surfaces thereof, said wiper edges biased against the strip, whereby the strip is cleaned as it is retracted.

21. The tube-cleaning apparatus of claim 20 wherein the biasing is such that, with the strip removed from between the wiper edges, the wiper edges are closer to one another than the thickness of the strip.

22. The tube-cleaning apparatus of claim 21 wherein the grip handle is formed of two half handles, each half handle being integrally-formed and including one of the wiper edges.

23. The tube-cleaning apparatus of claim 22 wherein:

the opposed wiper edges are biased against the strip; and the structures are tapered toward their edges and of a material such that the wiper edges are resiliently deformable, thereby to closely engage the strip.

* * * * *